United States Patent [19]

MacArthur

[11] Patent Number: 4,836,115

[45] Date of Patent: Jun. 6, 1989

[54] VERTICAL FURNACE

[76] Inventor: Charles E. MacArthur, 4 Vaughn St., Dover-Foxcroft, Me. 04426

[21] Appl. No.: 210,659

[22] Filed: Jun. 23, 1988

[51] Int. Cl.[4] ..... F23B 7/00

[52] U.S. Cl. ..... 110/234; 110/118; 110/256; 110/293; 122/30; 126/68; 126/73

[58] Field of Search ..... 110/256, 293, 118, 234; 122/30; 126/7, 10, 11, 68, 73, 74

[56] References Cited

U.S. PATENT DOCUMENTS 392,899 11/1888 Williams ..... 126/68
4,413,571 11/1983 Hill et al. ..... 110/118 X

FOREIGN PATENT DOCUMENTS 885335 5/1943 France ..... 110/293
444864 6/1934 United Kingdom ..... 110/293

*Primary Examiner*—Edward G. Favors

[57] ABSTRACT

A down-draft, gravity fed, bio-mass, solid fuel burning stove or furnace comprises an upright cylindrical housing having a top cover and a fire resistant openable air-tight floor. Fuel drops onto the center of the floor through a central feed tube where it burns in the form of a truncated conical pile. A second tube surrounds the feed tube, defining with it an annular air intake passage for discharging an annular current of air downwardly on the burning fuel. A heat exchanger surrounds the housing and its inner wall defines with the housing a smoke passage for upward escape of the hot gases of combustion. Heat from the smoke passage heats the contents of the heat exchanger. A baffle in the smoke passage enhances heat transfer. The central tube and cover are removable as a unit.

12 Claims, 2 Drawing Sheets

VERTICAL FURNACE

This invention relates to stoves and furnaces and provides a new and improved down-draft, self-feeding, solid bio-mass fuel burning stove or furnace capable of providing radiant heat and/or remote heat by the heating of a medium circulated through a heat exchanger. The unit will hereinafter be referred to interchangeably as either "stove" or "furnace."

BACKGROUND OF THE INVENTION

All prior art stoves of which I am aware are of the "magazine type." That is to say, they are designed to hold a fixed amount of fuel in an internal container which is capped by a lid. From the point of view of physical resemblance to the present invention, perhaps the most material prior art stove is the soft coal burner disclosed in U.S. Pat. to Cowles No. 806,323. The physical construction of this stove is similar but not the same and the mode of operation is significantly different.

In the Cowles stove, a charge of soft coal is placed in a vertically arranged central magazine suspended in a housing to be discharged for burning as a pile on an open grate beneath. Surrounding the magazine is an annular hot-air-down-draft space which can sweep the pile of burning coal with a throttled annular current of downwardly directed air. Additional air in controlled amount is introduced through the bottom grate. After being charged with coal the magazine is capped with an air-tight cover so that the magazine will be free of air drafts during the burning. Similar arrangements are disclosed in U.S. Pat. Nos. 1,506, 2,459, 132,211, 253,144 and 811,199 all of which introduce air from the bottom through a grate as well as from above.

OBJECT OF THE INVENTION

It is an object of the present invention to provide an improved down-draft type of bio-mass burning stove or furnace wherein all the air is supplied from above and the fuel may be self-feeding to the combustion zone through a central tube around which the air is supplied in an annular stream and which requires no pumps or blowers for operation and which may be used in connection with a heat exchanger for heating a circulating medium. By "bio-mass" is meant plant materials and animal waste used as a source of fuel, including wood, wood chunks, scrap wood, loose or hogged or chipped wood, pressed sawdust, etc. Coal is excluded because it requires air from below to burn properly (see Cowles U.S. Pat. No. 806,323 as an example).

SUMMARY OF THE INVENTION

In accordance with the invention, there is provided a gravity fed solid bio-mass fuel burning furnace which comprises an upright cylindrical housing, having a top cover and a fire resistant air-tight floor and defining with the latter a combustion chamber within the lower portion of said housing. A pair of concentric mutually spaced vertically arranged tubes are located within the housing. The inner tube comprises a fuel feed tube having a fuel receiving opening through the top cover and a fuel discharge opening spaced above the floor for feeding fuel to the combustion chamber. The outer tube defines with the inner surface of the housing an annular smoke passage for the upward flow of the hot gaseous products of combustion, and also defines with the inner tube an annular passage surrounding the feed tube and having an air intake opening through the top cover and an annular air discharge opening into the combustion chamber for directing an annular current of air from the intake opening downwardly into the combustion chamber while simultaneously insulating the fuel feed tube from the heat of the smoke passage. The furnace includes an outlet from the housing for the gaseous products of combustion. Thus solid fuel may drop by gravity through the feed tube to the floor to be burned in the combustion chamber while forming on the floor a conical pile of burning fuel and ash whose conical surface is continuously swept by said downwardly directed annular current of air.

Also within the scope of the invention is the inclusion of an exterior jacket surrounding the housing and defining therewith a heat exchanger through which any desired medium (e.g. liquids, solids or gases or a combination thereof) may be passed and heated by heat transfer from the hot gaseous products passing through the annular smoke passage.

In preferred embodiments, the annular smoke passage is provided with at least one internal fin in thermal contact with the inner wall of the heat exchanger, preferably in the form of an internal spiral baffle, to prolong contact of the hot gaseous products with adjacent surfaces of the heat exchanger and to increase the heat exchanging surface of the heat exchanger; the fin may span the smoke passage or extend only part way across it from the inner wall of the heat exchanger; means are provided permitting removal of ashes from the combustion chamber, preferably by making the floor of the housing at least partially removable; a legged stand is provided for supporting the furnace; and the inner and outer tubes and housing top cover comprise a unitary assembly the top of which is supported on the rim of the housing.

Still further objects, features and advantages of the invention will become apparent from the following detailed description of a presently preferred embodiment thereof taken in conjunction with the accompanying drawings.

DETAILED DESCRIPTION OF PREFERRED EMBODIMENT

Figure 1:
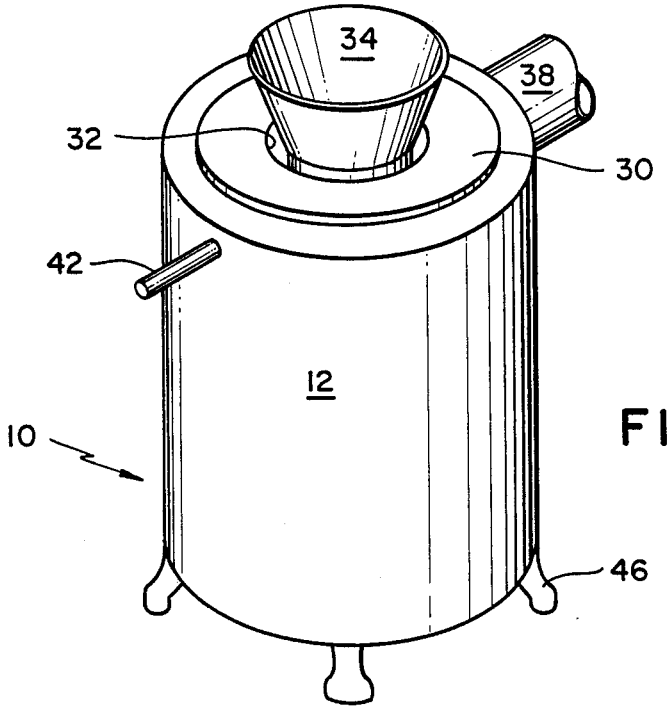
FIG. 1 is a view in perspective of the novel furnace illustrating its external appearance.
Figure 2:
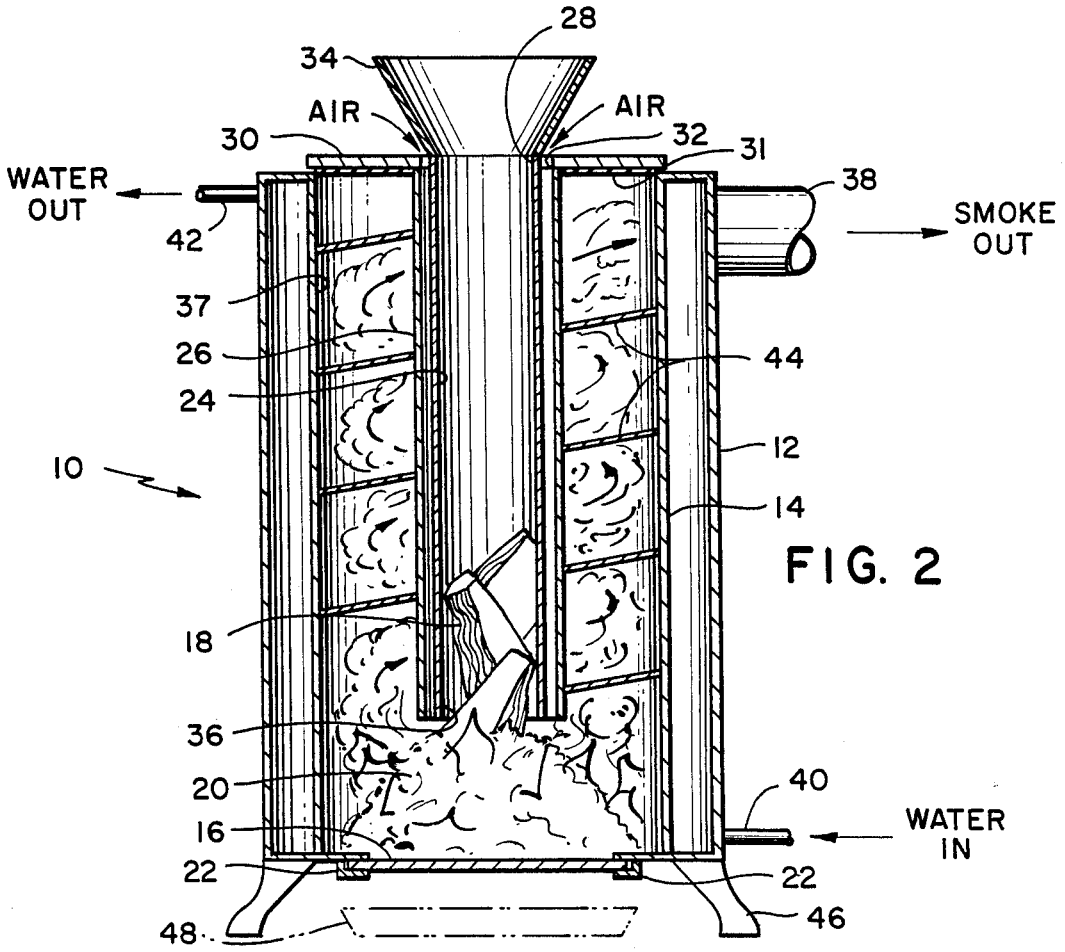
FIG. 2 is a vertical section through the furnace illustrating how the fuel is fed by gravity downwardly to the center of the combustion zone and disclosing one form of fin (in this case a helical baffle) mounted in the smoke passage.

FIGS. 1 and 2 illustrate the overall novel furnace 10 of the invention provided with optional water-jacket 12 surrounding the inner structure and comprising a heat exchanger for the heating of, e.g. domestic hot water.

The furnace itself comprises a cylindrical housing 14 which, in this preferred embodiment, is surrounded by the heat exchanger 12. The housing 14 is provided with an openable fire-resistant air-tight bottom 16 serving as a floor on which the fuel 18 drops and burns to form a conical pile 20 of flaming fuel and ash. The bottom 16 is slidably held at 22, so that it can be slid toward the viewer as seen in FIG. 2 to release accumulated ashes into an ash pan 48 (shown in broken lines).

Within the housing 14 is mounted a pair of concentric mutually spaced tubes 24, 26. The innermost tube 24 comprises a fuel feed tube having a fuel admitting opening 28 through the cover 30 of the furnace. The outermost tube 26 is spaced a small distance from the tube 24 and defines therewith an annular passage for the admission of combustion air with an air inlet at 32 through the cover 30. Above the opening 28 there is provided a fuel feed funnel 34 for directing unburned fuel 18 into the top of fuel feed tube 24. The assembly of funnel 34, tube 24 and cover 30 is bodily removable, resting as it does on flange which caps the chamber 37, for cleaning and replacement, as with a back-up down firing oil burner for use if solid fuel is unavailable.

The fuel, in this case wood chunks, to be burned drops by gravity onto the center of floor 16 from the lower open end of feed tube 24 and, as it burns, builds a conical pile 20 of fuel and ashes the apex of which reaches the region of the open end 36 of fuel feed tube 24, thus blocking the entry of further fuel until it has burned down a sufficient distance to admit the same.

The external surface of tube 26 is spaced from the inner wall of housing 14 and defines therewith an annular passage 37 through which rise the hot gaseous products of combustion from the fire below. The hot gases exit through smoke pipe 38 which is in communication with the top of passage 37 and may be connected to a suitable chimney not shown.

In order to use the furnace of the invention to heat liquid, such as water for domestic use or house heating, the housing 14 is optionally surrounded by heat exchanger water-jacket 12. It defines with the exterior of housing 14 an annular passage which maximizes contact of the liquid to be heated with the hot outer surface of housing 14. The liquid is fed to the heat exchanger through cold water inlet 40 and hot water exits through outlet 42.

The efficiency of the furnace for liquid heating purposes is greatly enhanced by provision in the annular smoke passage 37 of means to increase the area of contact of hot gases with the metal surface of the heat exchanger and, preferably, also to lengthen the path of travel of the gases so as to prolong their contact with such area. This is accomplished by mounting one or more fins or baffles within the passage 37, attached, as by welding, to the inner surface of housing 14. Preferably, there is employed for this purpose a spiral baffle 44, which not only increases the area of heat transfer but also slows the flow of the hot gases and prolongs their contact with the baffle and housing 14 thereby increasing heat transfer to the liquid in the heat exchanger.

Figure 3:
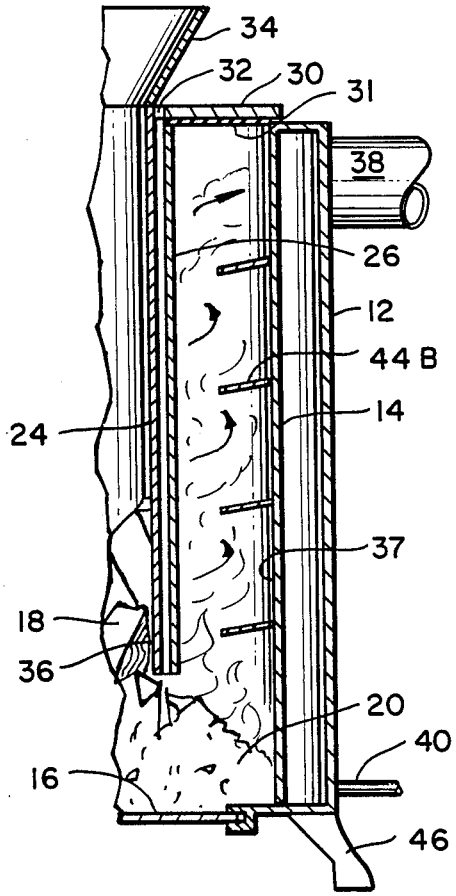
FIG. 3 is a fragmentary vertical sectional view of an alternative form of fin, in this case a spiral baffle which does not span the smoke passage.
Figure 4:
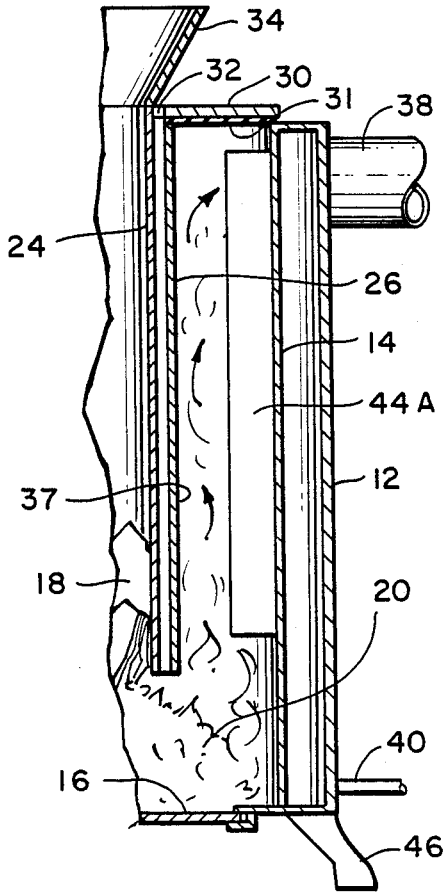
FIG. 4 is a similar view showing a still further modified form of fin, in this case one or more vertical fins which serve to increase the available heat exchange surface.

Alternate forms of baffle are disclosed in FIGS. 3 and 4. In the latter a series of vertical fins 44A, which may or may not span the smoke passage, are attached to the inner surface of the housing 14. In the former, a spiral baffle 44B is employed, in this case one which does not extend the entire width of the passage.

Desirably the entire unit is supported on legs 46, ashes being periodically emptied into ash pan 48 for removal by sliding open the air tight floor 16.

It will be seen that chunks of fuel 18 may be dropped manually through funnel 34 into tube 26 until it is partially or completely full. The fire will burn at its own rate, allowing additional chunks to fall onto the flaming cone 20 as the latter burns down. The combustion air entering through passage 32 cools the outside of tube 24 to below ignition temperature through most of its length to prevent backfiring upwardly through tube 24.

OPERATION AND ADVANTAGES

It will be seen that the basic feature of the bio-mass furnace is that of a gravity fed, vertical axis, open topped combustion chamber with a center tube 24 large enough to convey unignited fuel 18 by gravity down through the center of the device to a point near the floor 16 of the combustion chamber, that point being determined by the ability of the fuel emerging from the feed tube to form a conical pile 20 on the fire chamber floor 16, the piling being a function of size, shape and dryness of fuel pieces. The second tube 26, of slightly greater diameter, defines with the fuel feed tube an annular air inlet 32 to supply pre-heated combustion air solely to the truncated apex of the fuel pile. Emerging from this annular ring, the hot combustion air may sweep down the face of the conical pile, oxidizing the fuel.

As the burning fuel is reduced in bulk by combustion, more gravity fed fuel automatically replenishes the fuel pile to the proper shape. The products of combustion, "hot" gases, induced by chimney drafts of the order of 0.01" water gauge or more of natural draft, and being less dense than the descending "cold" intake air, expand to travel upward outside the air tube, giving up some heat to the air tube, which preheats incombing combustion air, but giving up the majority of the heat to the heat exchanger surfaces.

In a preferred embodiment, the hot gases are induced to dwell longer in the unit to extract more of the heat available by spiraling upwardly between the outside diameter of the air tube and the inside diameter of the heat exchanger jacket 14, guided by means of continuous or intermittent helically formed baffles 44. The hot gases thus are caused to remain longer in contact with the heat exchanger surfaces and the helical baffles. The latter also function as heat transfer surfaces, as they are attached to the heat exchanger jacket's inner wall 14 thereby substantially increasing its heat receptor surface. The pitch of the helix 44 determines the proportionate increase in hot gas to heat exchanger contact time, which may be increased by a factor of four to five times over the effect if the gases were allowed to rise, undirected, immediately to the chimney connection vent 38. Alternative fin arrangements for enhancing heat transfer are shown in FIGS. 3 and 4.

The inner wall 14 of the heat exchanger, which is the outer wall of the combustion chamber housing, is the contact surface for the media (hot water, hot air, etc.) to be heated. The preferred heat exchange media is water, which can be heated in quantities sufficient to heat homes and buildings with modest to substantial heat loads. It may be run continuously or intermittently for batch loading, and will reignite when new fuel is added after substantial standby times.

The unit contains no moving parts, dampers or controls, and consists only of welded assemblies which remain in place due to the force of gravity.

LIGHTING THE FURNACE

The unit is easy to light off. Seasoned wood chunks, blocks of various sizes, are dropped down the center tube onto the floor 16 to form a truncated conical fuel pile the top of which touches or may extend just into the very bottom of the fuel tube. A single sheet of newspaper is wadded into a ball small enough to easily drop down the center tube. Ignited with a match, the ball falls to the top of the fuel pile. Natural chimney draft of not less than 0.01" water gauge will draw the fire from the burning paper forcefully down into the fuel pile, which will quickly ignite. As the newspaper is burning, a small amount of fuel may be dropped in on top of the fire ball. This will result in an increased velocity of the air fanning the fire, and will improve immediate combustion. State of the fire may be determined by the sound produced by combustion, a low roaring sound. As the sound continues undiminished, more wood is added until the fuel tube is filled to a desired level, usually of the order of half way. This level is not critical. If fuel is not reasonably dry, or is too large for the tube being used, the fire may on rare occasions, fail. A gloved hand will have no trouble emptying the tube down to a point near the bottom of the feed tube, and another newsprint fireball may be dropped in to reestablish the fire.

At first glance one would doubt that the furnace could be safely operated without backfiring occurring up through the fuel feed tube 24. Experimental use of a prototype stove has shown that this does not happen and that the down drafts induced in both the fuel inlet 28 and the air inlet 32 effectively prevent upward flaming. Indeed, temperatures in the funnel 34 at the top of the stove are not much above ambient room temperature.

CLEANING

The novel unit is easy to clean. Ash buildup on the bottom of the chamber is removed (once a week in heavy use if fuel is clean) by slipping back the air tight fire resistant bottom cover which forms the floor of the fire chamber. The feed/air supply tube is easily lifted out of the unit, and an offset handled brush can sweep away the light powder dusting the heat exchanger upper surfaces. This is not often required. There are no nuts or bolts to be removed to clean the device, all parts rest in place without fasteners.

FUEL FEED AND FUEL

The unit is easy to feed. Chunks of wood or pellets, chips, loose or compressed sawdust are simply poured into the top of the feed tube until it is filled to a point satisfactory to the operator. Conveyor or screw feeds (not shown) with sensor controls can be set automatically to fill to a desired point. Amount of heat to be produced may be controlled by interrupting the feeding at any point. Self-relighting takes place from a bed of coals to be found on the combustion chamber floor when intermittent operation is desired.

The unit burns a variety of bio-mass fuels. Waste wood products from fine sawdust to wood chunks in lengths just less than the fuel tube diameter are readily consumed. Slabs and edging of greater lengths may be used under operator supervision.

The combustion process requires no dampers or combustion moderating controls, other than those mentioned above, for length of burn. No seals or gaskets are required. The amount of air flowing through the unit increases as the heating process is established, and then stabilizes. No shutters or drafts need be considered. A barometric damper attached to the chimney to prevent excessive drafts developing may be used as a conservation device, but is not required by the unit itself.

AUTOMATIC OPERATION

There are no electrical requirements for operation. The unit may be run in remote locations where electricity is not present, with its heat output distributed by thermosyphoning of heated air or water. It may also be connected directly to large tanks of water to supply long wave infrared radiation as space heating.

There are no pumps or blowers required for the unit itself, but they may be used to carry off the heat products of the unit as required.

The unit may heat liquids or gases by conduction, convection and radiation. It may serve as an independent "dutch oven" to supply heat in the form of hot gases to other devices. Generally, it requires no jacket. The air tight floor on which the conical fuel pile is formed is a removable grate or fuel base.

POSSIBLE USES

The unit burns at high temperatures. Thus the stove may be used for incineration, as for the destruction of restaurant scraps and greases. Its ingestion of air may be used (for example) in place of a restaurant grill fan, sucking cooking smoke into the unit for incineration and discharging the gases to the exterior through the smoke pipe.

Once started, the unit itself is virtually smokeless, likely to meet all pollution standards unmodified.

As mentioned, a removable downward firing oil burner (not shown) may be held in reserve as a backup for times when solid fuels are not available or during times when families or staff are not present. The oil burner, on a swingover or drop-in mount, requires no tools for installation to fire downwardly into the housing.

The fuel/air tubes of varied dimensions are instantly changeable for the best burn by type of fuel being supplied, each tube designed to form the proper conical fuel pile for good combustion. Fuel/air tubes are simple and inexpensive to build.

In the fuel/air tubes combustion air is preheated by the hot outer wall of the air tube to improve ignition. At the same time the air cools the outer walls of the fuel tube, decreasing premature ignition inside the fuel tube. Some combustion may begin in the lower reaches of the fuel tube in spite of the cooling effect, but early flames in this location are of no concern. An overhead water can with a commercial sprinkler head installed may serve as a failsafe device for the faint hearted. In prototype testing not a single incident of flame escaping from the top of the feed tube has occurred. Chuck woods which may have been exposed to surface moisture in storage benefit from the drying effect of air that is sucked down the feed tube, washing over the blocks. Vagrant process heat in the feed tube only assists in final drying of the fuel.

Visual inspection of fire is always possible, just by looking down through the fuel or air tubes. No inspection ports are required, nor is any smoke released during the inspection process.

The unit burns very low cost woodwaste, some costing less than 10% of prepared commercial fuels.

The unit accelerates to full burn very quickly and furnishes a very rapid heat rise in the heat media.

The unit may be used with heat reclaimers in the smoke pipe. There is little or no ash to be found in heat reclaimers.

While there has herein been disclosed and described a presently preferred embodiment of the invention, it will nevertheless be understood that the same is susceptible of modification and change by those skilled in the art. Accordingly, it is intended that the scope of the invention be limited only by the proper interpretation to be accorded the appended claims.

I claim:

1. A gravity fed bio-mass solid fuel burning furnace which comprises an upright cylindrical housing, said housing having a top cover and a fire resistant floor and defining with the said floor a combustion chamber within the lower portion of said housing, a pair of concentric mutually spaced vertically arranged tubes within said housing, the inner tube comprising a fuel feed tube having a fuel receiving opening through said top cover and a fuel discharge opening spaced above said floor through which fuel may drop onto said floor, the outer tube defining with the inner surface of said housing an annular smoke passage for the upward flow of the hot gaseous products of combustion, and defining with said inner tube an annular air intake passage surrounding said feed tube and having an air inlet at its upper end and an annular air discharge opening at its lower end into said combustion chamber above said floor for directing an annular current of air from said opening downwardly into said combustion chamber while simultaneously insulating at least in part said fuel feed tube from the heat of said smoke passage, means preventing the entry of air into said combustion chamber except through said intake passage, and means permitting escape of said gaseous products from said housing, whereby solid fuel dropping onto said floor from said feed tube may burn while forming a generally truncated conical pile of burning fuel and ash the conical surface of which is continuously swept by said downwardly directed annular current of air.

2. The furnace of claim 1 including an exterior jacket surrounding said housing and defining therewith a heat exchanger through which fluid may be passed and heated by the passage of said hot gaseous products through said annular smoke passage.

3. The furnace of claim 1 wherein said annular smoke passage is provided with at least one internal fin attached to the inner surface of said housing for increasing the area of heat transfer from said gaseous products to said heat exchanger.

4. The furnace of claim 3 wherein said internal fin comprises a spiral baffle to prolong contact of said hot gaseous products with adjacent surfaces of said heat exchanger.

5. The furnace of claim 4 wherein said baffle extends less than the width of said smoke passage.

6. The furnace of claim 4 wherein said baffle is attached to both the inner surface of said housing and the outer surface of said outer tube so as to span the entire width of said smoke passage.

7. The furnace of claim 1 including means permitting removal of ashes from said combustion chamber.

8. The furnace of claim 7 wherein said permitting means comprises an at least partially removable floor for said housing.

9. The furnace of claim 8 wherein said removable floor is air-tight when closed.

10. The furnace of claim 1 including a legged stand supporting said furnace.

11. The furnace of claim 1 wherein said inner tube and cover comprise a unitary assembly supported on the rim of said housing and removable as a unit therefrom.

12. A gravity fed bio-mass solid fuel burning furnace which comprises an upright housing, said housing having a top cover and a fire resistant floor and defining with said floor a combustion chamber within the lower portion of said housing, inner and outer mutually spaced vertically arranged tubes within said housing, the inner tube comprising a fuel feed tube having a fuel receiving opening through said top cover and a fuel discharge opening spaced above said floor through which fuel may drop onto said floor, the outer tube defining with the inner surface of said housing a smoke passage for the upward flow of the hot gaseous products of combustion, and defining with said inner tube an air intake passage surrounding said feed tube and having an air inlet at its upper end and an air discharge opening at its lower end into said combustion chamber above said floor for directing a current of air from said opening downwardly into said combustion chamber while simultaneously insulating at least in part said fuel feed tube from the heat of said smoke passage, means preventing the entry of air into said combustion chamber except through said intake passage, and means permitting escape of said gaseous products from said housing, whereby solid fuel dropping onto said floor from said feed tube may burn while forming a truncated pile of burning fuel and ash the surface of which is continuously swept by said downwardly directed annular current of air.

* * * * *

UNITED STATES PATENT AND TRADEMARK OFFICE

CERTIFICATE OF CORRECTION

PATENT NO. : 4,836,115

DATED : June 6, 1989

INVENTOR(S) : Charles E. MacArthur

It is certified that error appears in the above-identified patent and that said Letters Patent is hereby corrected as shown below:

Col. 4 line 28, '0.01"' should be -- -.01" --;

Col. 5 line 6, '0.01"' should be -- -.01" --;

Col. 6 line 54, "Chuck" should be -- Chunk --.

Signed and Sealed this

Thirteenth Day of March, 1990

*Attest:*

*Attesting Officer*

JEFFREY M. SAMUELS

*Acting Commissioner of Patents and Trademarks*